US010830423B2

(12) United States Patent
Fujisawa

(10) Patent No.: US 10,830,423 B2
(45) Date of Patent: Nov. 10, 2020

(54) ANGLE ADJUSTMENT DEVICE AND LIGHTING DEVICE

(71) Applicant: MINEBEA MITSUMI INC., Kitasaku-gun, Nagano (JP)

(72) Inventor: Shinichi Fujisawa, Akiruno (JP)

(73) Assignee: MINEBEA MITSUMI INC., Nagano (JP)

( * ) Notice: Subject to any disclaimer, the term of this patent is extended or adjusted under 35 U.S.C. 154(b) by 14 days.

(21) Appl. No.: 15/479,606

(22) Filed: Apr. 5, 2017

(65) Prior Publication Data

US 2017/0292687 A1 Oct. 12, 2017

(30) Foreign Application Priority Data

Apr. 11, 2016 (JP) ..... 2016-078625

(51) Int. Cl.
*F21V 21/30* (2006.01)
*F21S 8/02* (2006.01)
(Continued)

(52) U.S. Cl.
CPC ..... *F21V 21/30* (2013.01); *F21S 8/026* (2013.01); *F21V 21/28* (2013.01); *F21V 21/043* (2013.01);
(Continued)

(58) Field of Classification Search
CPC ..... F21S 8/02; F21S 8/038; F21S 8/04; F21S 8/022; F21S 8/024; F21S 8/026; F21S 8/028; F21V 14/02; F21V 17/02; F21V 17/06; F21V 17/08; F21V 21/044; F21V 21/14; F21V 21/28; F21V 21/30; F21V 21/49; F21V 21/04; F21V 21/041;
(Continued)

(56) References Cited

U.S. PATENT DOCUMENTS 4,517,632 A * 5/1985 Roos ..... F21V 21/403 188/163
5,038,261 A * 8/1991 Kloos ..... F21V 21/14 362/286
(Continued)

FOREIGN PATENT DOCUMENTS

CA 2889468 A1 * 10/2015 ..... F21V 14/02
GB 2497925 A 7/2013
(Continued)

OTHER PUBLICATIONS

May 22, 2018 Office Action issued in Japanese Patent Application No. 2016-078625.
(Continued)

*Primary Examiner* — Alexander K Garlen
*Assistant Examiner* — Colin J Cattanach
(74) *Attorney, Agent, or Firm* — Oliff PLC

(57) ABSTRACT

An angle adjustment device of an embodiment includes a first rotational unit and a spring member. The first rotational unit is supported by a frame body, and rotationally moves around a first rotating shaft that passes through the frame body and that is disposed along an opening surface of the frame body, by a driving force of a driving source with an object to be operated. The spring member urges the first rotational unit in a single direction of a rotational direction.

8 Claims, 14 Drawing Sheets

(51) Int. Cl.

| | |
|---|---|
| ***F21V 21/14*** | (2006.01) |
| ***F21V 21/04*** | (2006.01) |
| ***F21V 21/26*** | (2006.01) |
| ***F21V 21/15*** | (2006.01) |
| ***F21V 21/28*** | (2006.01) |
| ***F21V 29/76*** | (2015.01) |

(52) U.S. Cl.
CPC ..... *F21V 21/045* (2013.01); *F21V 21/046* (2013.01); *F21V 21/049* (2013.01); *F21V 21/14* (2013.01); *F21V 21/15* (2013.01); *F21V 21/26* (2013.01); *F21V 29/763* (2015.01)

(58) Field of Classification Search
CPC .... F21V 21/042; F21V 21/043; F21V 21/045; F21V 21/046; F21V 21/047; F21V 21/048; F21V 21/049; F21V 21/15; F21V 21/26; F21W 2131/205; F21Y 2103/10; A61B 90/30; A61B 90/309; A61B 90/35
See application file for complete search history.

(56) References Cited

U.S. PATENT DOCUMENTS 6,328,458 B1 * 12/2001 Bell ..... F16M 11/10 362/288
6,880,957 B2 * 4/2005 Walters ..... F21V 23/0442 250/205
7,011,435 B1 * 3/2006 Blaymore ..... F21V 21/15 362/371
7,191,992 B2 * 3/2007 Wagner ..... F16M 11/10 248/276.1
9,119,668 B2 * 9/2015 Marka ..... A61B 90/35
2009/0268474 A1 * 10/2009 Ward ..... F21S 8/02 362/364
2010/0149822 A1 * 6/2010 Cogliano ..... F21S 8/02 362/365
2010/0165646 A1 * 7/2010 Russo ..... F21S 8/02 362/430
2014/0185302 A1 * 7/2014 Ebisawa ..... F21V 5/007 362/311.01
2014/0254163 A1 * 9/2014 Boomgaarden ..... F21V 21/30 362/272
2015/0276190 A1 * 10/2015 Devlin ..... F21V 21/15 362/362
2016/0186967 A1 * 6/2016 Mathews ..... F21V 21/30 362/368
2017/0038046 A1 * 2/2017 Bardot ..... F21V 3/00

FOREIGN PATENT DOCUMENTS

| | | | |
|---|---|---|---|
| JP | H03-71510 | U | 7/1991 |
| JP | 2004-034799 | A | 2/2004 |
| JP | 2009-076391 | A | 4/2009 |
| JP | 2012-069502 | A | 4/2012 |
| JP | 2014-186805 | A | 10/2014 |
| WO | 2015/155106 | A1 | 10/2015 |

OTHER PUBLICATIONS

Jan. 30, 2018 Office Action issued in Japanese Patent Application No. 2016-078625.
Jun. 8, 2017 Extended European Search Report issued in Patent Application No. 17165822.2.
Apr. 8, 2020 Office Action issued in Chinese Patent Application No. 201710232085.

* cited by examiner

ANGLE ADJUSTMENT DEVICE AND LIGHTING DEVICE

CROSS-REFERENCE TO RELATED APPLICATION(S)

The present application claims priority to and incorporates by reference the entire contents of Japanese Patent Application No. 2016-078625 filed in Japan on Apr. 11, 2016.

BACKGROUND OF THE INVENTION

1. Field of the Invention

The present invention relates to an angle adjustment device and a lighting device.

2. Description of the Related Art

Conventionally, a lighting device such as a downlight (universal) that can change the irradiation direction to any desired direction has been provided. The lighting device such as this includes an angle adjustment device for changing the facing direction of a light source (light emitting surface) that is an object to be operated, to a desirable direction. For example, in the lighting device installed on a ceiling surface and the like, the angle adjustment device changes the direction of the light source in the vertical direction (tilted direction), around a shaft in the horizontal direction (Japanese Laid-open Patent Publication No. 2012-069502).

However, in the above-described conventional technology, it is difficult to rotationally move the object to be operated in a smooth manner. For example, in the lighting device, if there is a location where the direction of gravity torque around the shaft in the horizontal direction is reversed, it is difficult to rotationally move the object to be operated around the location in a smooth manner.

The present invention is made for the foregoing reasons, and an objective of the present invention is to provide an angle adjustment device by which an object to be operated is rotationally moved in a smooth manner, and to provide a lighting device.

SUMMARY OF THE INVENTION

It is an object of the present invention to at least partially solve the problems in the conventional technology.

An angle adjustment device according to an embodiment includes a first rotational unit and a spring member. The first rotational unit is supported by a frame body, and rotationally moves around a first rotating shaft passing through the frame body, the shaft being disposed along an opening surface of the frame body, by a driving force of a driving source with an object to be operated. The spring member urges the first rotational unit in a single direction of a rotational direction.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Hereinafter, a lighting device including an angle adjustment device according to an embodiment will be described with reference to the accompanying drawings. It should be noted that the usage of an angle adjustment device 2 is not limited to the following embodiment. The drawings are schematic, and it should also be noted that the dimensional relation of the components and the ratios of the components, for example, may differ from the actual ones. It should further be noted that the respective drawings may include portions that have different dimensional relations and ratios.

Embodiment

Figure 1:
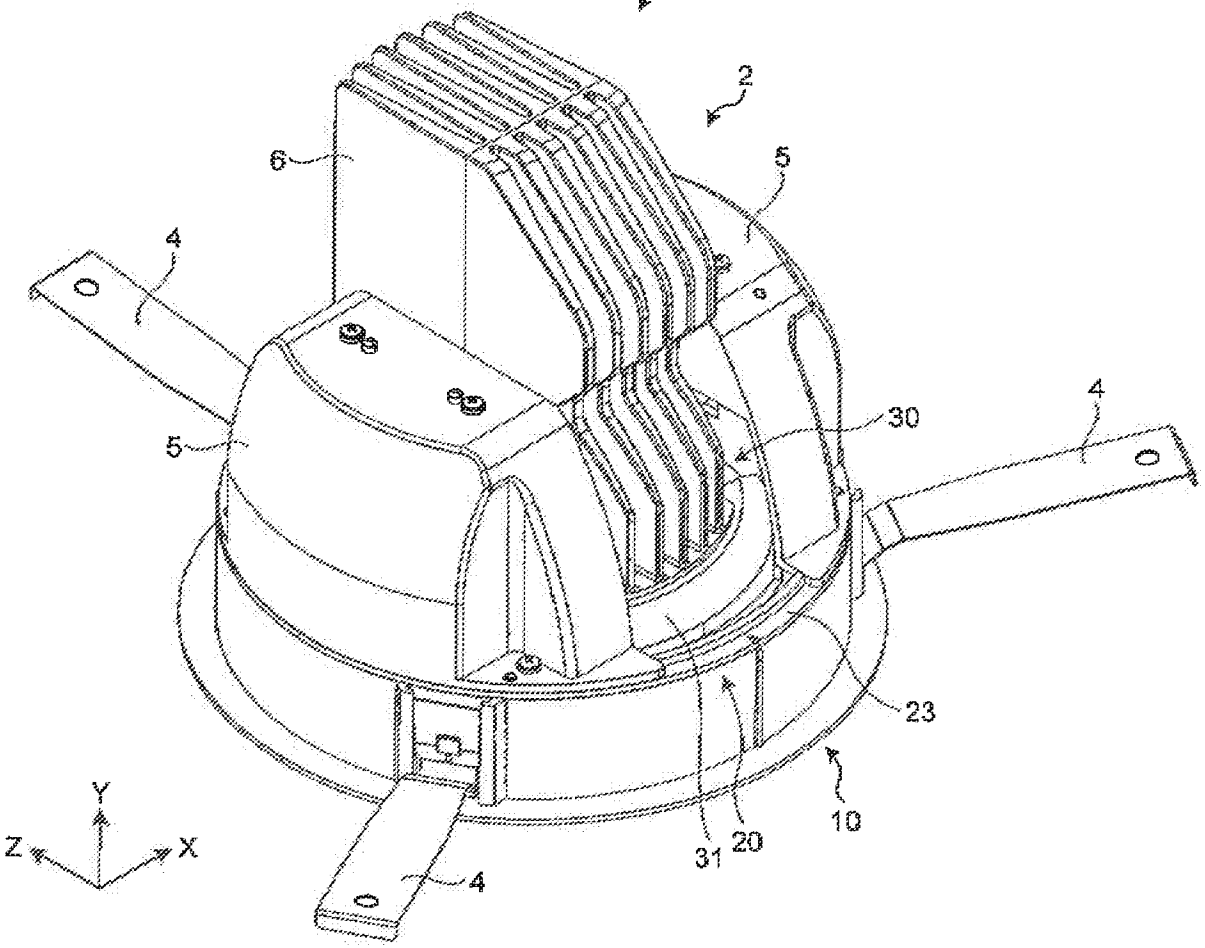
FIG. 1 is a perspective view illustrating a lighting device according to an embodiment.
Figure 2:
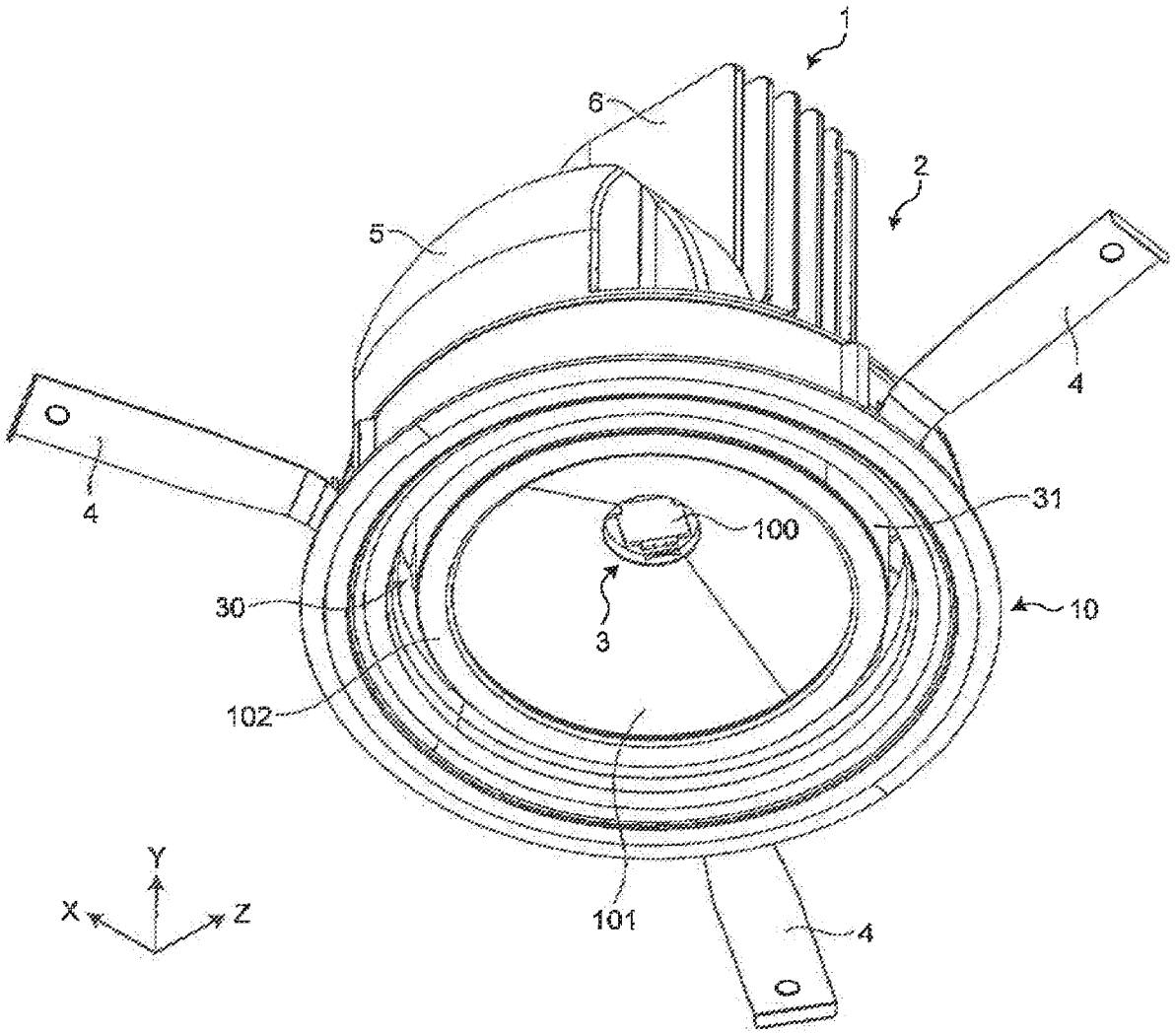
FIG. 2 is a perspective view illustrating the lighting device according to the embodiment.
Figure 3:
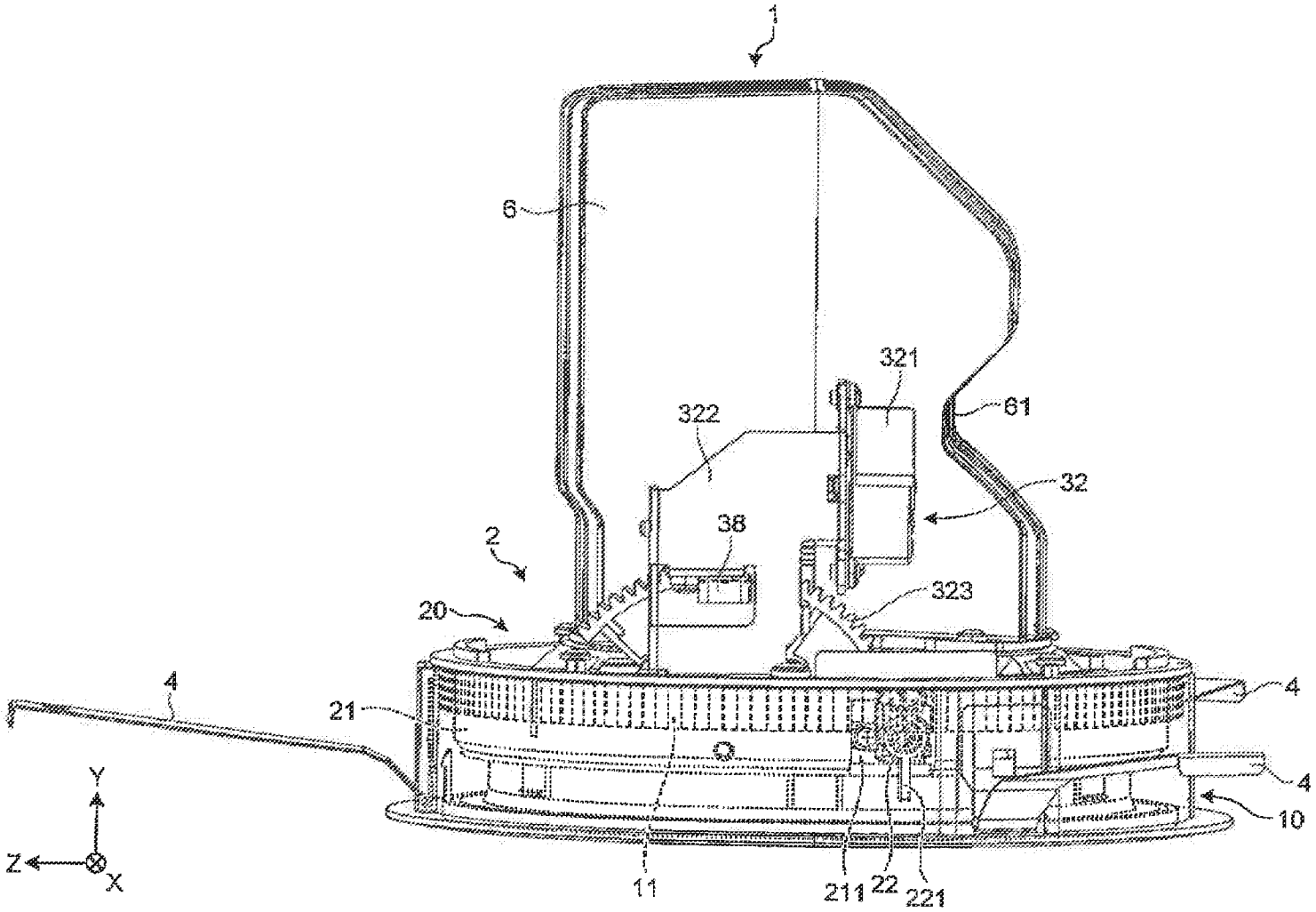
FIG. 3 is a side view (partial perspective view) illustrating the lighting device according to the embodiment.

First, an overview of the configuration of a lighting device 1 will be described with reference to FIG. 1 to FIG. 3. FIG. 1 and FIG. 2 are perspective views each illustrating a lighting device according to an embodiment. More specifically, FIG. 1 is a perspective view of the lighting device 1, when viewed from the opposite side of a light source unit 3. Furthermore, FIG. 2 is a perspective view of the lighting device 1, when viewed from the light source unit 3 side. In FIG. 2, a lens (optical member) is omitted so as to illustrate a light source 100 of the light source unit 3. FIG. 3 is a side view (partial perspective view) illustrating the lighting device according to the embodiment. More specifically, FIG. 3 is a diagram of the lighting device 1, when seen through a frame body 10.

In the following, a Y axis indicates a direction along a rotating axis (second rotating axis) of a second rotational unit 20, which will be described below, and an X axis and a Z axis indicate axes that are orthogonal to each other in the plane perpendicular to the Y axis. For example, the X axis is a direction along a rotating shaft (first rotating shaft) of a first rotational unit 30 at a position (initial position) when the lighting device 1 is to be mounted. In the following, an explanation on the configuration of the lighting device 1 will be made based on the initial position state of the lighting device 1, except where change in direction such as an inclination of the lighting device 1 is referred.

The lighting device 1 includes the light source unit 3, the frame body 10, the angle adjustment device 2, a plurality (in the present embodiment, three pieces) of fixtures 4, a cover 5, and a heat sink 6. The light source unit 3 is an object to be operated the direction of which is to be changed. For example, the light source unit 3 includes the light source 100 such as a light emitting diode (LED), a reflection plate 101, and a holding member 102 for holding the lens described above. The light source 100 may be a chip on board (COB) and the like. The light source unit 3 is mounted on the angle adjustment device 2, and the details will be described later. The heat sink 6 is mounted on the first rotational unit 30 of the angle adjustment device 2, and projects in the positive Y axis direction. In the lighting device 1, in addition to the projecting portion of the heat sink 6, the cover 5 is provided on the side opposite to the side toward which the light source 100 and the reflection plate 101 face.

Figure 4:
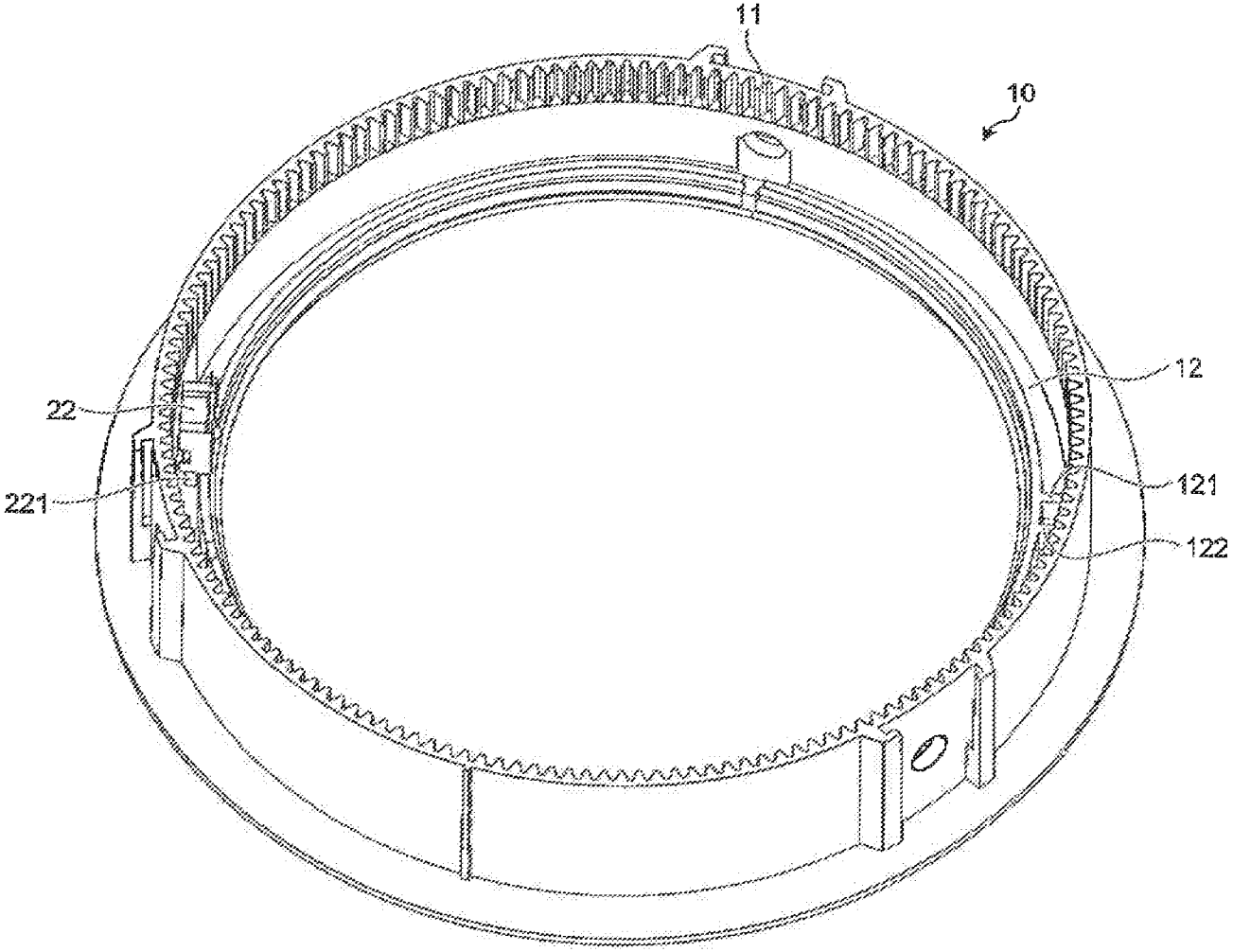
FIG. 4 is a perspective view illustrating a frame body according to the embodiment.

As illustrated in FIG. 4, the frame body 10 has a cylindrical shape (sectional surface has an annular shape). FIG. 4 is a perspective view illustrating a frame body according to the embodiment. For example, the frame body 10 is embedded in an embedding hole that is provided on a ceiling surface and the like. For example, the frame body 10 is formed of resin or the like. The fixtures 4 are fixed on the outer periphery of the frame body 10 at equal intervals in the circumference direction, and the frame body 10 is fixed in the embedding hole by the fixtures 4. In the following, the positive Y axis direction is the upward direction, the negative Y axis direction is the downward direction, and a direction perpendicular to the Y axis is the horizontal direction. In this case, for example, the negative Y axis direction is the gravity direction, and a plane perpendicular to the Y axis is a horizontal plane.

Internal teeth 11 are formed on the inner peripheral surface of the frame body 10. More specifically, the internal teeth 11 are formed along the inner periphery of an end (hereinafter, also referred to as an "upper end") of the frame body 10 in the shaft direction. Furthermore, an inner flange unit 12 is formed on the inner peripheral surface of the frame body 10. More specifically, the inner flange unit 12 that extends toward the center from the inner peripheral surface is formed on the other end (hereinafter, also referred to as a "lower end") of the frame body 10 in the shaft direction. A pair of projection units 121 and 122 that project to the upper end side are formed on the inner flange unit 12. In the lighting device 1, the projection units 121 and 122 of the frame body 10, and a limit switch 22, which will be described below, restrict the rotational movement of the angle adjustment device 2 around the shaft of the frame body 10, and the details will be described later. In FIG. 4, the limit switch 22 is illustrated to indicate the positional relation with the projection units 121 and 122. However, the limit switch 22 is mounted on the second rotational unit 20, which will be described below.

The angle adjustment device 2 includes the second rotational unit 20, the first rotational unit 30, and a spring member 40, which will be described below.

Figure 5:
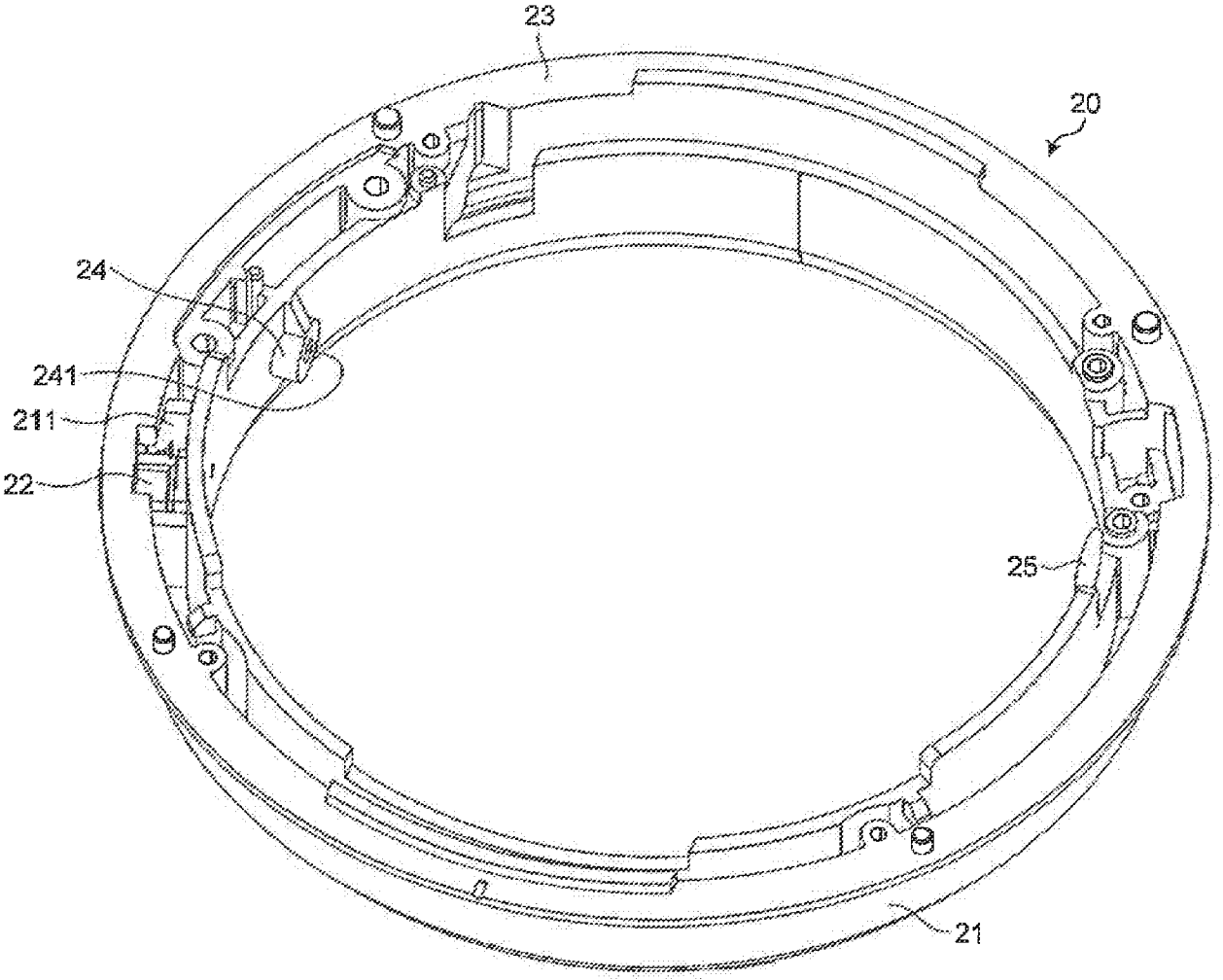
FIG. 5 is a perspective view illustrating a second rotational unit according to the embodiment.
Figure 6:
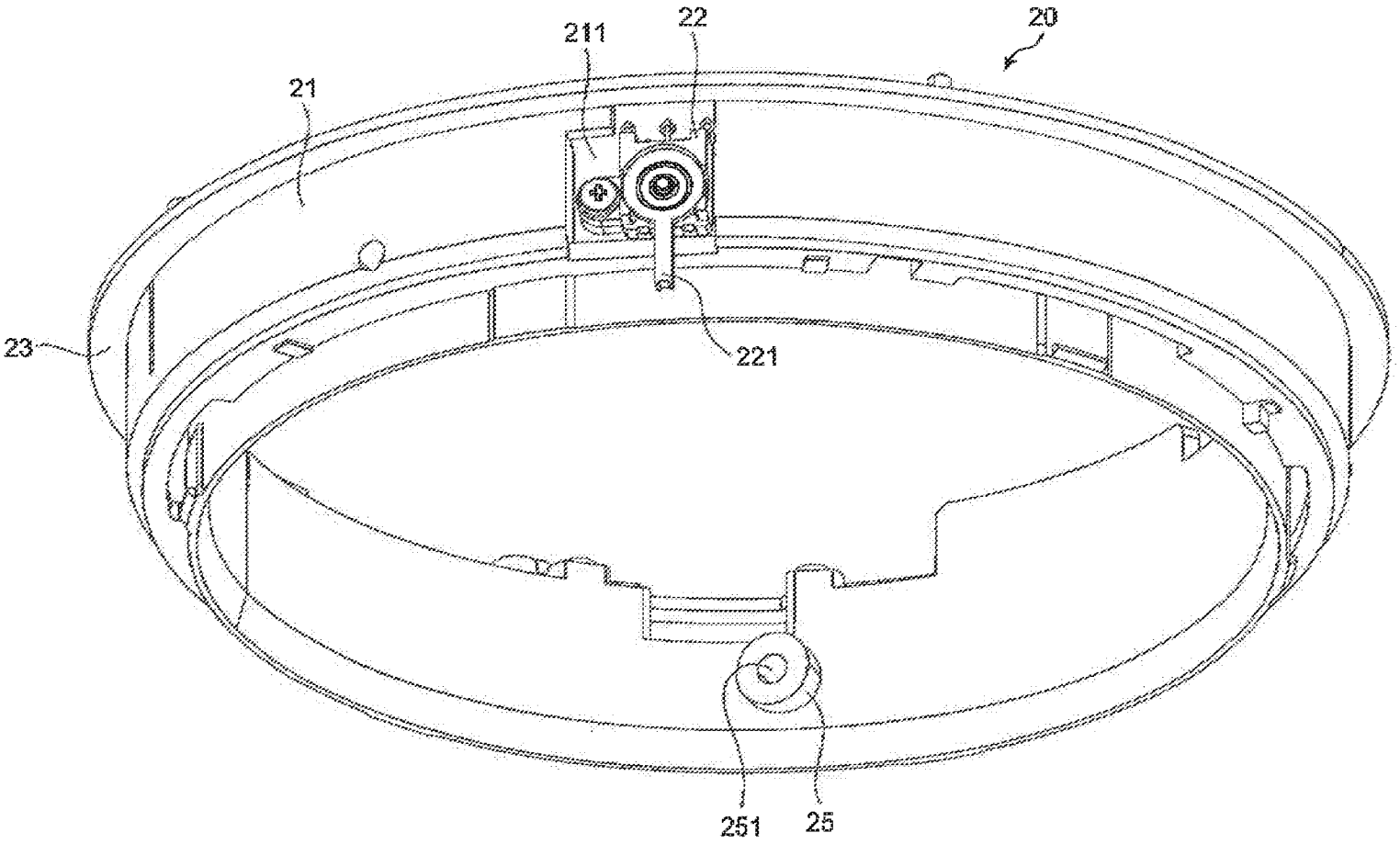
FIG. 6 is a perspective view illustrating the second rotational unit according to the embodiment.

As illustrated in FIG. 5 and FIG. 6, the second rotational unit 20 has a cylindrical shape. FIG. 5 and FIG. 6 are perspective views each illustrating a second rotational unit according to the embodiment. For example, the second rotational unit 20 is formed of resin or the like. The second rotational unit 20 includes a base unit 21. An outer flange unit 23 that extends toward the outside from the outer peripheral surface is formed on an end (hereinafter, also referred to as an "upper end") of the base unit 21 in the shaft direction. The outer flange unit 23 of the second rotational unit 20 is slidably supported by the upper end surface of the frame body 10. In this manner, the frame body 10 rotatably supports the second rotational unit 20 in the horizontal direction. Furthermore, bearing units 24 and 25 that rotatably support the first rotational unit 30 in the vertical direction are provided on the inner peripheral surface of the base unit 21 of the second rotational unit 20, and the details will be described later.

The limit switch 22 is disposed in a concave 211 that is formed on a part of the outer periphery of the base unit 21. Furthermore, the pair of projection units 121 and 122 are provided on the inner flange unit 12 of the frame body 10 as described above. Consequently, the projection units 121 and 122 of the inner flange unit 12 restrict the rotation of the second rotational unit 20 in the horizontal direction that is caused by a second driving unit 27, which will be described below. A lever 221 is provided on the limit switch 22. In other words, the angle adjustment device 2 electrically detects a rotating operation of the second rotational unit 20 in the horizontal direction, using the limit switch 22 that is disposed in the concave 211 of the base unit 21 as well as the projection units 121 and 122 of the inner flange unit 12.

The angle adjustment device 2 detects the limit of the rotation angle that has been set, when the lever 221 of the limit switch 22 is rotationally moved by one of the projection units 121 and 122 of the inner flange unit 12. The limit is used to control the motor, such as to stop operating a second motor 271, which will be described below. In the present embodiment, the rotation angle of the second rotational unit 20 in the horizontal direction is in a range substantially 360 degrees, by the limit switch 22 as well as the projection units 121 and 122 of the inner flange unit 12.

Figure 7:
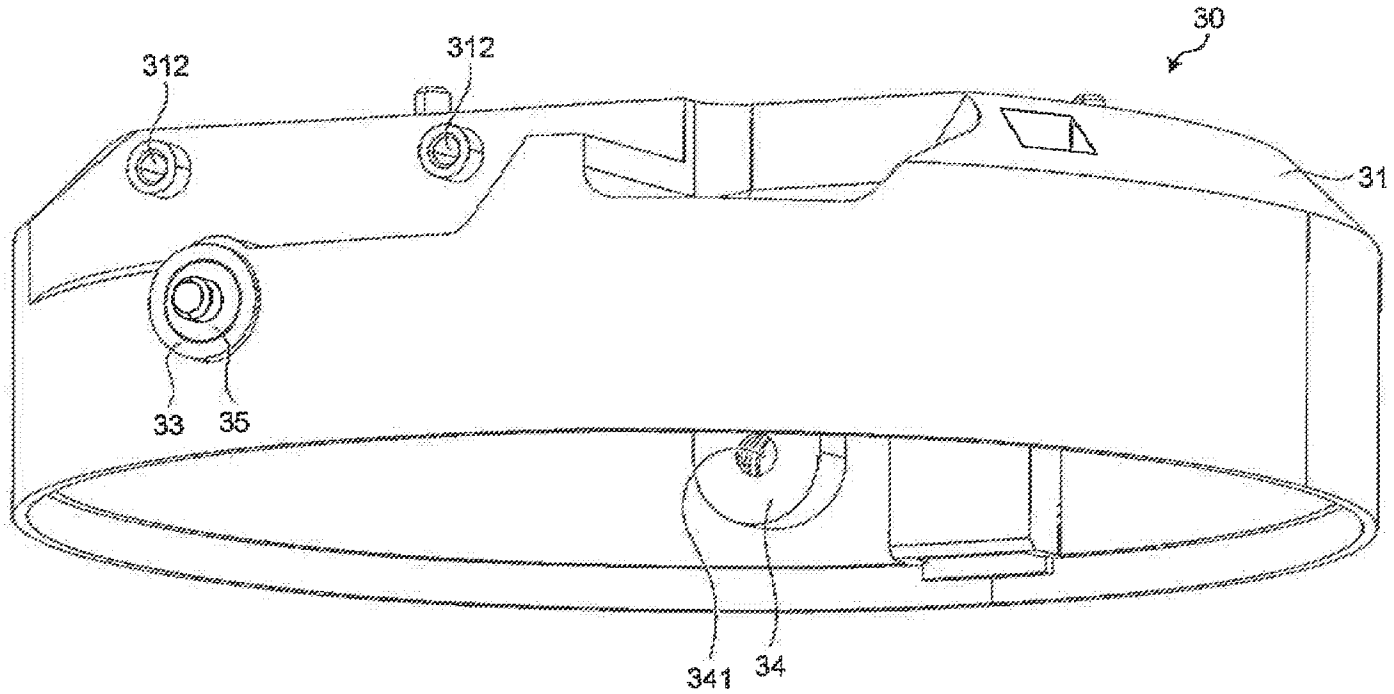
FIG. 7 is a perspective view illustrating a first rotational unit according to the embodiment.
Figure 8:
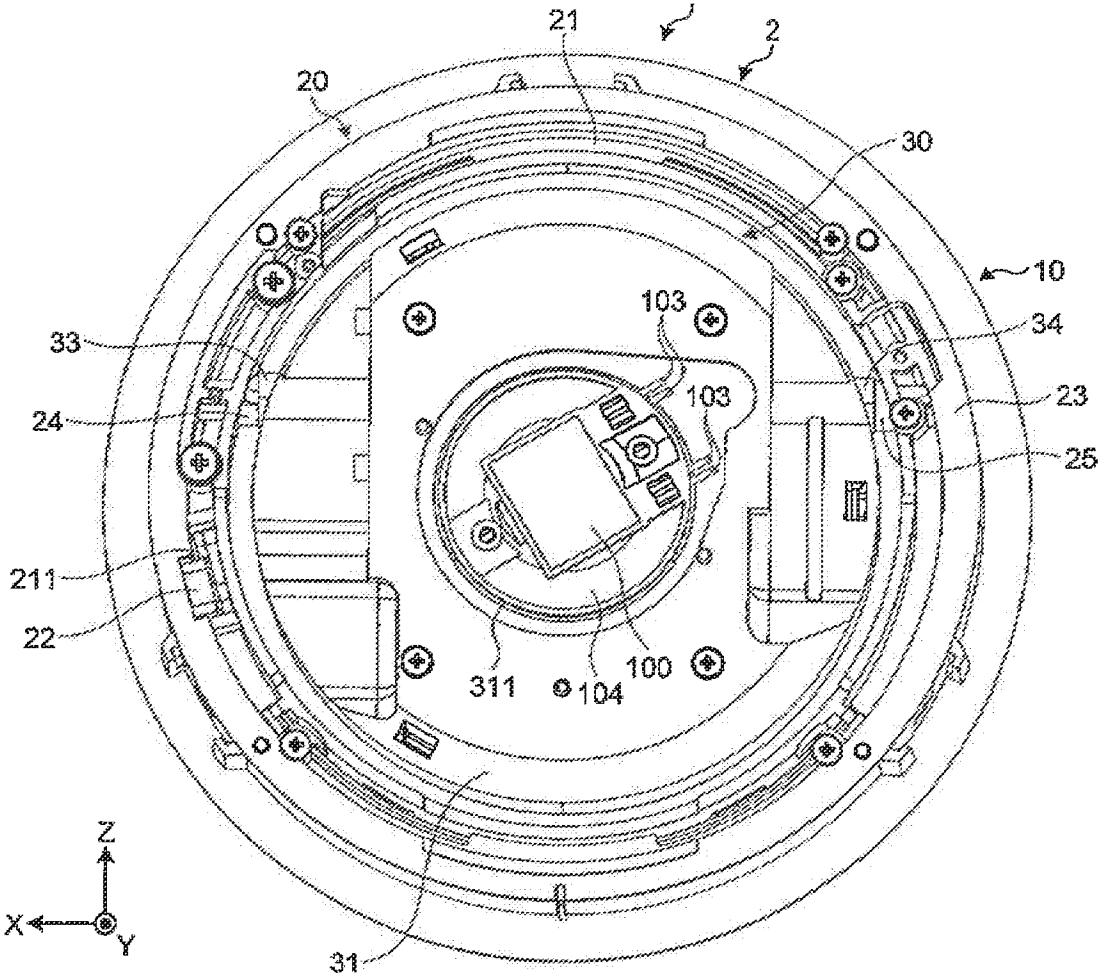
FIG. 8 is a plan view illustrating the lighting device according to the embodiment.

As illustrated in FIG. 7 and FIG. 8, the first rotational unit 30 has a hollow columnar shape (sectional surface has an annular shape), one side of which is opened. FIG. 7 is a perspective view illustrating a first rotational unit according to the embodiment. FIG. 8 is a plan view illustrating the lighting device according to the embodiment. More specifically, FIG. 8 is a plan view excluding the cover 5, the heat sink 6, and the like of the lighting device 1, to illustrate the first rotational unit 30. For example, the first rotational unit 30 is formed of resin or the like. The first rotational unit 30 includes a base unit 31 one surface of which in the shaft direction is formed with a through hole 311. A holding member 104 for holding the light source 100 to which power is supplied by a cable 103 and the like is disposed in the through hole 311 of the base unit 31. A fixing hole 312 for fixing a first driving unit 32, which will be described below, is provided on a part of the outer peripheral surface of the base unit 31, and the details will be described later.

Furthermore, a pair of pivotally supporting parts 33 and 34 are provided on the outer peripheral surface of the first rotational unit 30. The pair of pivotally supporting parts 33 and 34 are disposed on a single straight line (same straight line) that is perpendicular to the shaft line of the first rotational unit 30. For example, in the lighting device 1 illustrated in FIG. 8, that is, in the lighting device 1 at the initial position, the pair of pivotally supporting parts 33 and 34 are disposed on a single straight line (same straight line) along the X axis. Furthermore, in the lighting device 1, the positions of the pivotally supporting parts 33 and 34 on the XZ plane are changed, due to the rotational movement of the second rotational unit 20.

An insertion hole 341 is formed in the center portion of the pivotally supporting part 34. Furthermore, similar to the insertion hole 341 of the pivotally supporting part 34, an insertion hole (not illustrated) is formed in the center portion of the pivotally supporting part 33, and an end of a shaft member 35 is fitted into the insertion hole of the pivotally supporting part 33. Furthermore, similar to the shaft member 35 of the pivotally supporting part 33, an end of a shaft member 35 is fitted into the insertion hole 341 of the pivotally supporting part 34.

The other ends of the shaft members 35 that are fitted into the pivotally supporting part 33 and the pivotally supporting part 34 are inserted into the bearing units 24 and 25, and are supported by the bearing units 24 and 25. For example, the other end of the shaft member 35 that is fitted into the pivotally supporting part 33 is inserted into an insertion hole 241 of the bearing unit 24. Furthermore, for example, the other end of the shaft member 35 that is fitted into the pivotally supporting part 34 is inserted into an insertion hole 251 of the bearing unit 25. In this manner, the second rotational unit 20 rotatably supports the first rotational unit 30 around the shaft line of the pivotally supporting parts 33 and 34, in the vertical direction (perpendicular direction).

As illustrated in FIG. 8, in the plan view of the first rotational unit 30, the shaft line of the pivotally supporting parts 33 and 34 passes through the base unit 31 of the first rotational unit 30 other than the center. More particularly, in FIG. 8, in the plan view of the first rotational unit 30, the shaft line of the pivotally supporting parts 33 and 34 extends in the direction along the X axis, and passes through the position that is shifted (offset) from the center of the base unit 31 of the first rotational unit 30, in the positive Z axis direction. In the following, a direction toward which the negative Z axis direction side of the shaft line of the pivotally supporting parts 33 and 34 of the first rotational unit 30 rotates in the downward direction, is referred to as a plus direction. Furthermore, a direction toward which the positive Z axis direction side of the shaft line of the pivotally supporting parts 33 and 34 of the first rotational unit 3Q rotates in the downward direction, is referred to as a minus direction.

The second driving unit 27 that rotatably drives the second rotational unit 20 in the horizontal direction and the first driving unit 32 that rotatably drives the first rotational unit 30 in the vertical direction will now be described.

Figure 9:
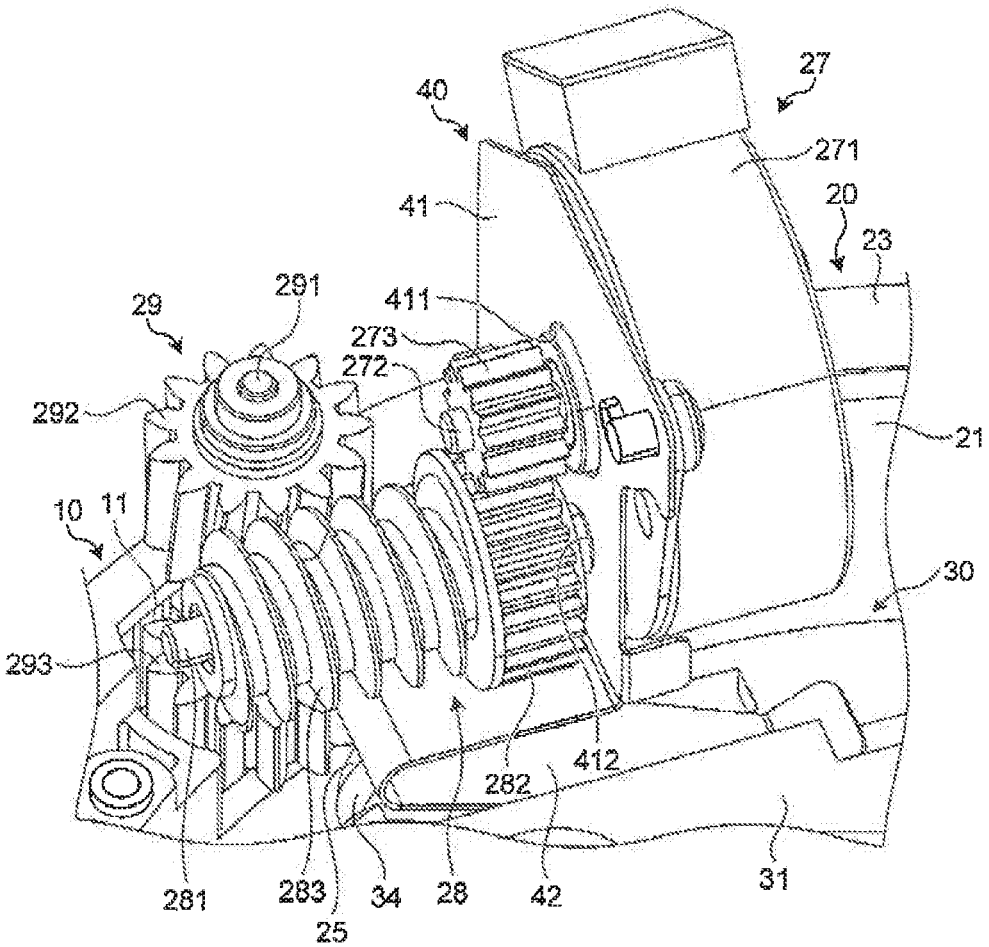
FIG. 9 is a perspective view illustrating a second driving unit according to the embodiment.
Figure 10:
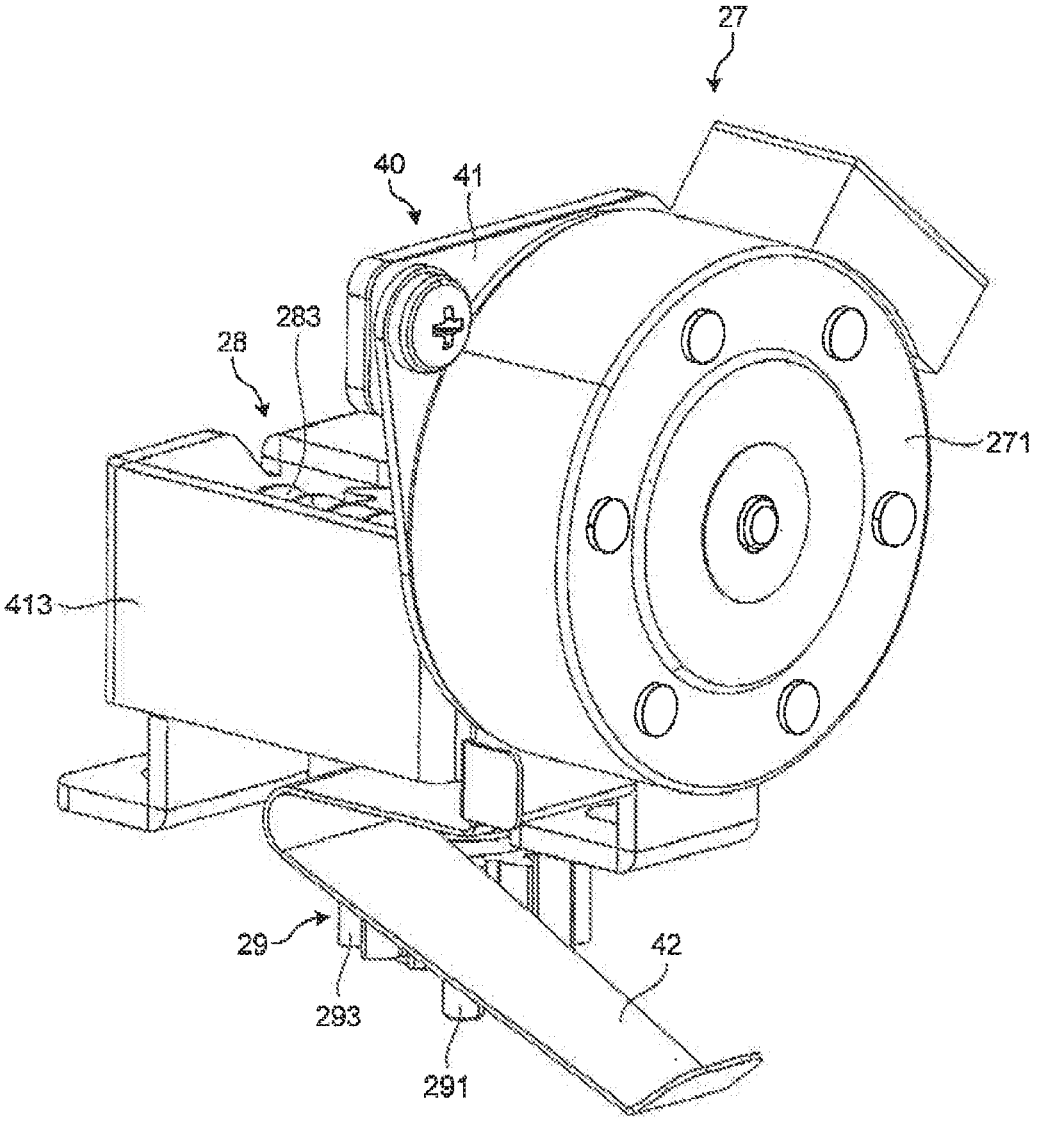
FIG. 10 is a perspective view illustrating the second driving unit according to the embodiment.

As illustrated in FIG. 9 and FIG. 10, the second driving unit 27 includes the second motor 271 serving as a driving source. A gear 273 is mounted on the tip end of an output rotating shaft 272 of the second motor 271. The second motor 271 is fixed to a second bracket unit 41 of the spring member 40 that is fixed to the second rotational unit 20. For example, when the output rotating shaft 272 is inserted into a through hole 411 of the second bracket unit 41, and when the second motor 271 is fixed to the second bracket unit 41 using a fixing mechanism such as a screw, the output rotating shaft 272 is disposed so that the direction of the output rotating shaft 272 is along the opening surface of the frame body 10. For example, the direction of the output rotating shaft 272 of the second motor 271 is the direction perpendicular to the Y axis. For example, a stepping motor is used for the second motor 271, and the second motor 271 is connected to a driving circuit (not illustrated) through a lead wire (not illustrated) extending from the second motor 271.

The gear 273 mounted on the output rotating shaft 272 is meshed with a gear 282 that is mounted on an end of a rotating shaft 281 of a second gear unit 28 at the side where the rotating shaft 281 of the second gear unit 28 is inserted into a through hole 412 of the second bracket unit 41. A worm 283 is mounted on the tip end of the rotating shaft 281 of the second gear unit 28. In other words, the worm 283 is the worm of a worm gear. The worm 283 is a screw-shaped gear having a cylindrical shape.

A shaft conversion unit 29 includes a rotating shaft 291, a worm wheel 292, and a gear 293. The worm wheel 292 of the shaft conversion unit 29 is meshed with the worm 283. In other words, the worm wheel 292 of the shaft conversion unit 29 and the worm 283 form a worm gear. Furthermore, the gear 293 of the shaft conversion unit 29 is meshed with the internal teeth 11 that are formed along the inner periphery of the frame body 10. Consequently, the second rotational unit 20 rotates in the horizontal direction corresponding to the output of the second driving unit 27. Furthermore, although not illustrated in FIG. 9, the spring member 40 includes a wall 413 that surrounds the periphery of the second gear unit 28 and the shaft conversion unit 29 as illustrated in FIG. 10.

The spring member 40 includes an urging unit 42 that is formed as a spring. The urging unit 42 continues to the lower end of the second bracket unit 41. The spring member 40 urges the first rotational unit 30 in the negative Y axis direction through the urging unit 42. More specifically, the urging unit 42 of the spring member 40 urges the positive Z axis direction side of the shaft line of the pivotally supporting parts 33 and 34 of the first rotational unit 30 in FIG. 8, in the downward direction. In other words, the urging unit 42 of the spring member 40 urges the first rotational unit 30 in the minus direction. For example, the urging unit 42 of the spring member 40 may urge the first rotational unit 30 over the entire rotation range in the vertical direction. Furthermore, the spring member 40 rotationally moves in the horizontal direction with the first rotational unit 30. The urging unit 42 of the spring member 40 may also be provided on a first bracket 322 (see FIG. 3), which will be described below. The first bracket 322 may be a spring member.

Figure 11:
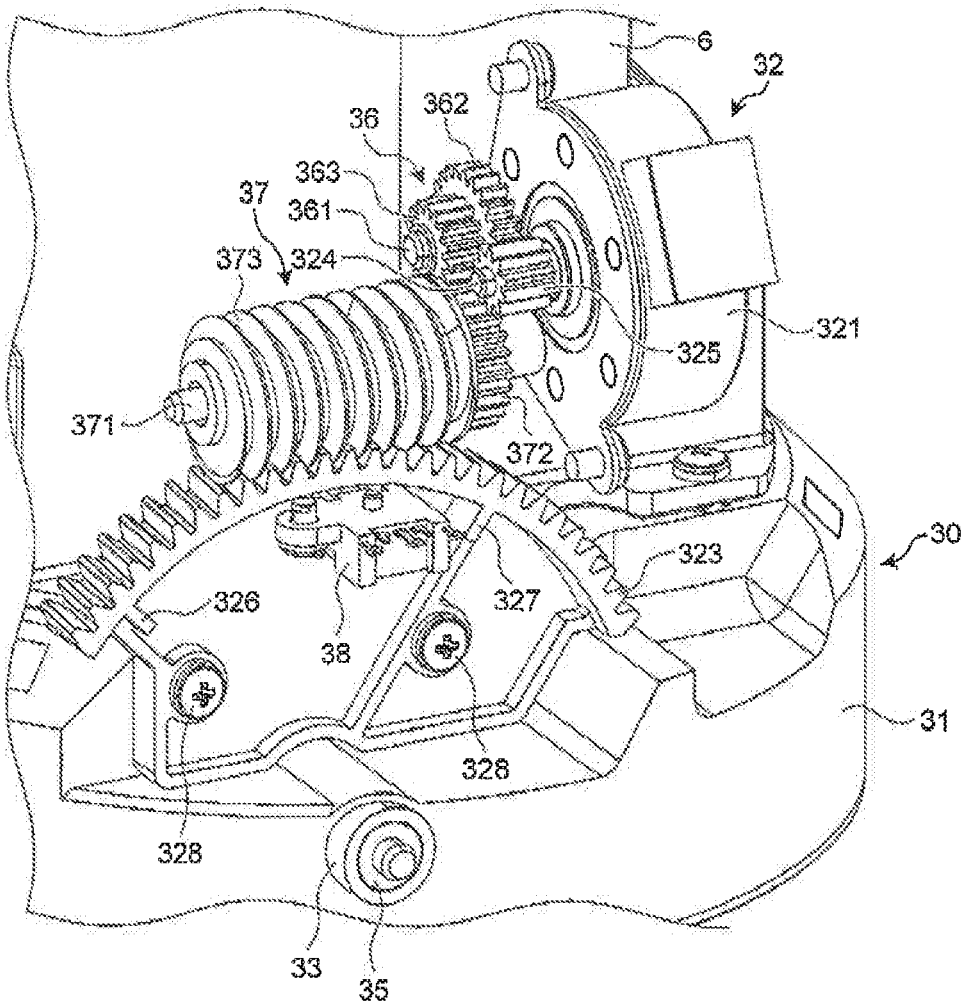
FIG. 11 is a perspective view illustrating a first driving unit according to the embodiment.

Next, the first driving unit 32 that rotationally moves the first rotational unit 30 will be described with reference to FIG. 11. FIG. 11 is a perspective view illustrating a first driving unit according to the embodiment. As illustrated in FIG. 11, the first driving unit 32 includes a first motor 321 serving as a driving source, the first bracket 322 (see FIG. 3), and a fixing gear 323. FIG. 11 illustrates a state excluding the first bracket 322 to describe the configuration of the first driving unit 32. Furthermore, the configuration of the first driving unit 32 illustrated in FIG. 11 indicates a position (state) when the first bracket 322 is holding the first driving unit 32.

A gear 325 is mounted on the tip end of an output rotating shaft 324 of the first motor 321. As illustrated in FIG. 3, the first motor 321 is fixed to the first bracket 322 that is fixed to the second rotational unit 20. For example, when the first motor 321 is fixed to the first bracket 322 using a fixing mechanism such as a screw, the output rotating shaft 324 is disposed so that the direction of the output rotating shaft 324 is along the opening surface of the frame body 10. For example, the direction of the output rotating shaft 324 of the first motor 321 is the direction perpendicular to the Y axis. For example, a stepping motor is used for the first motor 321, and the first motor 321 is connected to a driving circuit (not illustrated) through a lead wire (not illustrated) extending from the first motor 321.

The gear 325 mounted on the output rotating shaft 324 is meshed with a large diameter gear 362 that is mounted on a rotating shaft 361 of a stepped gear unit 36. A small diameter gear 363 is also mounted on the rotating shaft 361 of the stepped gear unit 36. The first bracket 322 rotatably supports the stepped gear unit 36.

A gear 372 mounted on a rotating shaft 371 of a second gear unit 37 is meshed with the small diameter gear 363 of the stepped gear unit 36. Furthermore, a worm 373 is mounted on the tip end of the rotating shaft 371 of the second gear unit 37. In other words, the worm 373 is the worm of a worm gear. The worm 373 is a screw-shaped gear having a cylindrical shape. The first bracket 322 rotatably supports the second gear unit 37.

The fixing gear 323 is meshed with the worm 373 of the second gear unit 37. In other words, the fixing gear 323 and the worm 373 form a worm gear. For example, the fixing gear 323 is fixed to the first rotational unit 30, when a screw member 328 is screwed into the insertion hole 341 (see FIG. 7) of the first rotational unit 30. Consequently, the first rotational unit 30 rotates in the vertical direction, corresponding to the output of the first driving unit 32.

A limit switch 38 is disposed on the first bracket 322. Furthermore, a pair of projection units 326 and 327 are formed on a surface facing the limit switch 38 of the fixing gear 323. Thus, the projection units 326 and 327 restrict the rotation of the first rotational unit 30 in the vertical direction that is caused by the first driving unit 32. A lever (not illustrated) similar to the lever 221 of the limit switch 22 is provided on the limit switch 38. In other words, the angle adjustment device 2 electrically detects the rotating operation of the first rotational unit 30 in the vertical direction, by the limit switch 38 fixed to the first bracket 322 as well as the projection units 326 and 327 of the fixing gear 323.

The angle adjustment device 2 detects the limit of the rotation angle that has been set, when the lever of the limit switch 38 is rotationally moved by one of the projection units 326 and 327 of the fixing gear 323. The limit is used to control the motor, such as to stop operating the first motor 321. In the present embodiment, the limit switch 38 and the projection units 326 and 327 of the fixing gear 323 restrict the rotation angle of the first rotational unit 30 in the vertical direction, to a range from −30 degrees to +45 degrees.

Figure 12:
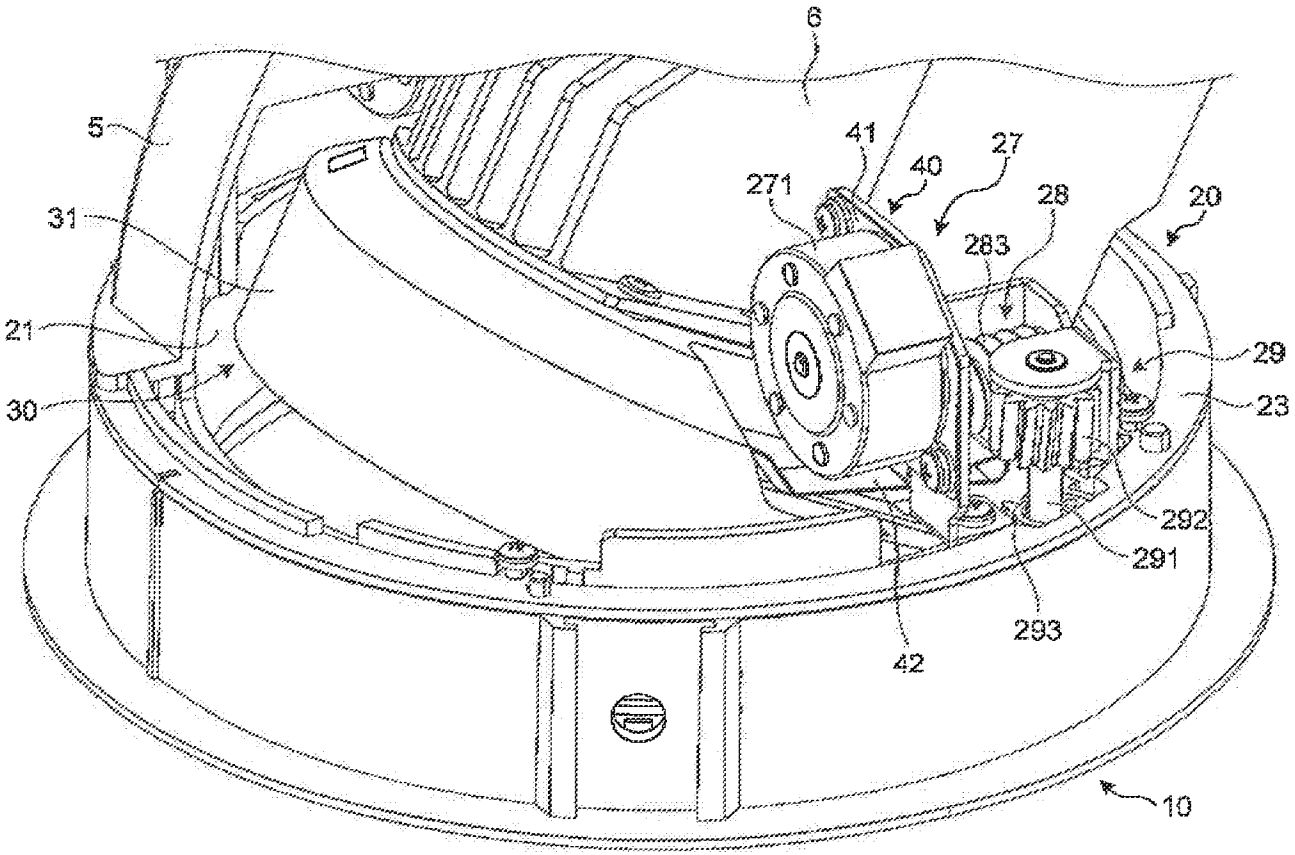
FIG. 12 is a main part perspective view illustrating an inclination of the lighting device according to the embodiment.

For example, FIG. 12 illustrates a state when the first rotational unit 30 is inclined in a direction toward which the negative Z axis direction side of the shaft line of the pivotally supporting parts 33 and 34 (see FIG. 11) of the first rotational unit 30 rotates in the downward direction, that is, when the first rotational unit 30 is inclined in the plus direction. FIG. 12 is a main part perspective view illustrating an inclination of the lighting device according to the embodiment. In this manner, the first rotational unit 30 can rotate to a predetermined angle in both vertical directions.

Figure 13:
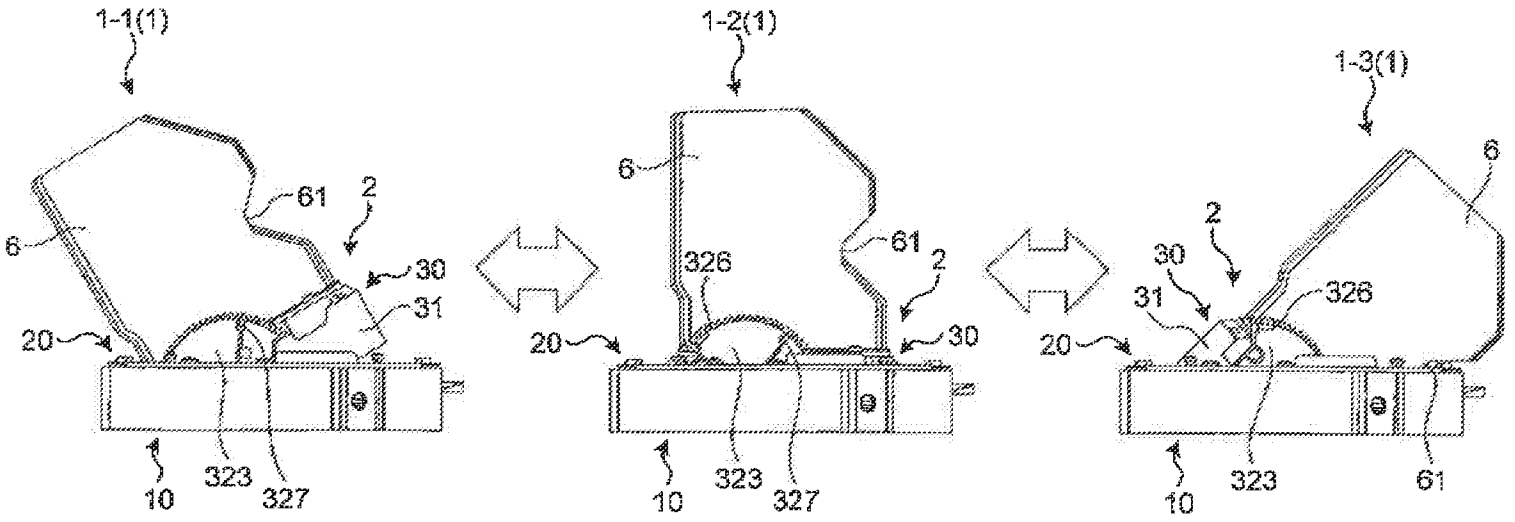
FIG. 13 is a diagram illustrating inclinations of the lighting device according to the embodiment.

The rotation of the lighting device 1 in the vertical direction will now be described with reference to FIG. 13. FIG. 13 is a diagram illustrating inclinations of the lighting device according to the embodiment. Lighting device 1-1 to lighting device 1-3 illustrated in FIG. 13 each illustrates the lighting device 1 of each irradiation direction. When the lighting devices 1-1 to 1-3 need not be distinguished from each other, they are referred to as the lighting device 1. The lighting device 1 illustrated in FIG. 13 is viewed from the negative X axis direction. The lighting device 1-1 to the lighting device 1-3 indicate states when the horizontal directions are the same, and when the lighting devices 1-1 to the lighting device 1-3 are rotated in the vertical direction so as to change the vertical direction.

The lighting device 1-2 in FIG. 13 is a diagram illustrating the initial state of the angle adjustment device 2. In the initial state of the angle adjustment device 2, the rotational position of the second rotational unit 20 in the horizontal direction is zero degree, and the rotational position of the first rotational unit 30 in the vertical direction is also zero degree. Furthermore, in the initial state of the angle adjustment device 2, the irradiation direction of the lighting device 1 is in the directly below direction (vertical direction). In other words, the irradiation direction of the lighting device 1-2 is in the downward direction (straight downward direction).

For the lighting device 1-1, the irradiation direction is a direction inclined by minus 30 degrees from the downward direction (oblique direction). For the lighting device 1-3, the irradiation direction is inclined by plus 45 degrees from the downward direction (oblique direction). In this manner, the lighting device 1 is rotatable to any desired position from the lighting device 1-1 to the lighting device 1-3. Furthermore, as illustrated by the lighting device 1-3, the lighting device 1 can be rotated to a desirable angle, by a notch unit 61 of the heat sink 6, without restriction of the rotation in the plus direction by the heat sink 6.

Figure 14:
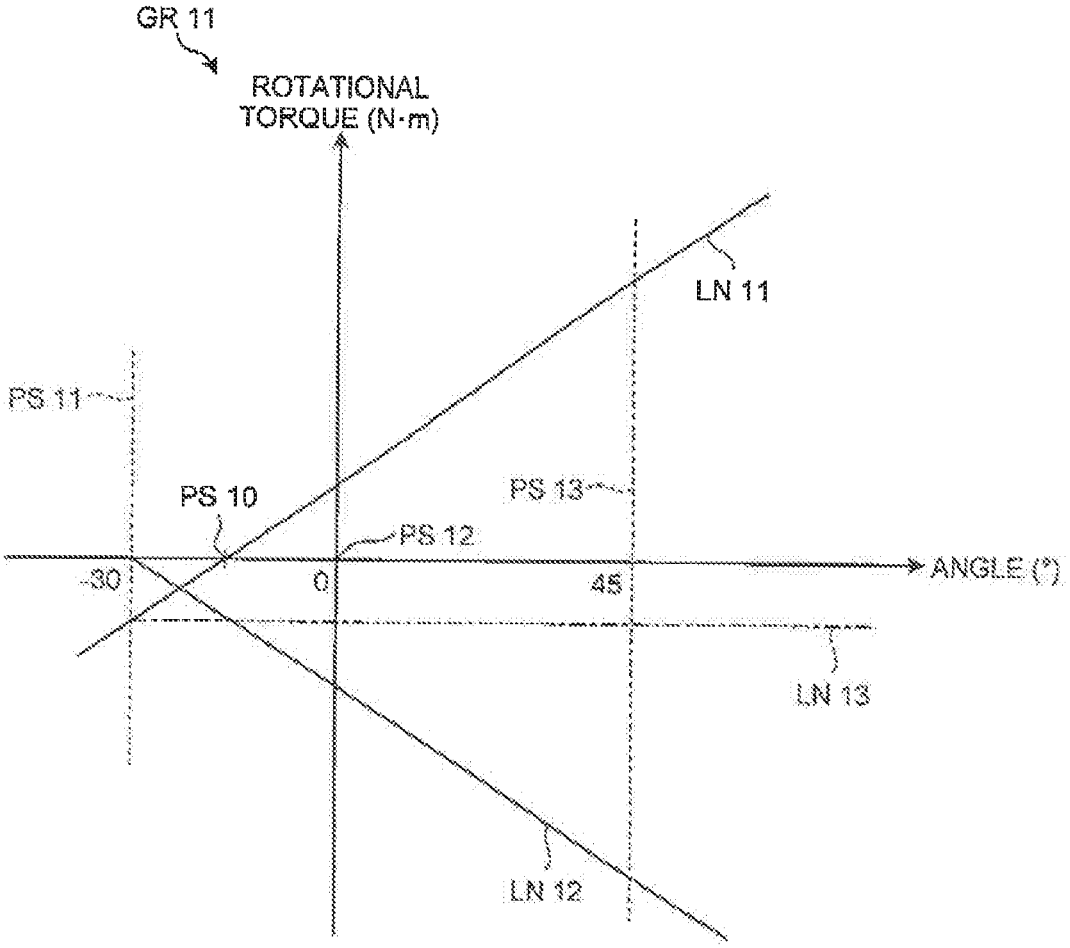
FIG. 14 is a diagram illustrating relations between the inclinations of the lighting device according to the embodiment and torque.

A relation between torque due to dead weight (hereinafter, also referred to as "dead weight torque") of a portion that is pivotally supported by the pivotally supporting parts 33 and 34 of the first rotational unit 30 (hereinafter, also referred to as a "pivotally supported part"), and torque applied to the first rotational unit 30 by the urging unit 42 of the spring member 40 (hereinafter, also referred to as "urging torque") will now be described with reference to FIG. 14. Furthermore, in the following, a combination of the dead weight torque and the urging torque is referred to as combined torque. FIG. 14 is a diagram illustrating relations between the inclinations of the lighting device according to the embodiment and torque. The portion pivotally supported by the pivotally supporting parts 33 and 34 of the first rotational unit 30 includes the first rotational unit 30, and the light source unit 3, the heat sink 6, and the like that are to be operated. The angle (°) that is the horizontal axis in the graph GR 11 of FIG. 14 indicates the inclination angle of the first rotational unit 30. Furthermore, the rotational torque (N·m) that is the vertical axis in the graph GR 11 of FIG. 14 indicates rotational torque around the shaft line of the pivotally supporting parts 33 and 34 of the first rotational unit 30.

The straight line LN 11 in the graph GR 11 of FIG. 14 indicates a relation between the dead weight torque (gravity moment) of the pivotally supported part and the inclination angle of the first rotational unit 30. The dead weight torque of the pivotally supported part is balanced at the position PS 10 (hereinafter, also referred to as a "neutral point"). In this manner, in the lighting device 1, the dead weight torque of the pivotally supported part is balanced in a state while the first rotational unit 30 is inclined to one side in the vertical direction, from the position PS 12 where the inclination angle is zero degree. In this manner, while the first rotational unit 30 is placed on the neutral point, the first rotational unit 30 is inclined relative to the horizontal plane (XZ plane) perpendicular to the gravity direction (negative Y axis direction).

As illustrated in the graph GR 11 of FIG. 14, when the first rotational unit 30 is not urged by the urging unit 42 of the spring member 40, the direction toward which the dead weight torque of the pivotally supported part is applied is changed to the minus direction and the plus direction, at the position PS 10 that is the neutral point. If there is a neutral point such as the above, it is difficult to rotate the first rotational unit 30 in a smooth manner.

Consequently, the urging force of the spring member 40 is set so that the urging torque is increased, as the urging unit 42 of the spring member 40 rotates in the plus direction from the position PS 11 of minus 30 degrees that is in the rotation range in the minus direction. In the example illustrated in FIG. 14, the urging torque of the spring member 40 is set so that the urging torque of the spring member 40 is applied from the position PS 11 of minus 30 degrees that is in the rotation range in the minus direction, to the position PS 13 of plus 45 degrees that is in the rotation range in the plus direction.

The straight line LN 12 in the graph GR 11 of FIG. 14 indicates a relation between the urging torque of the spring member 40 and the inclination angle of the first rotational unit 30. In this manner, when the spring member 40 applies the urging torque to the first rotational unit 30 from minus 30 degrees to plus 45 degrees, a certain combined toque is applied to the first rotational unit 30, over the entire rotation range of the first rotational unit 30.

The alternate long and short dash line LN 13 in the graph GR 11 of FIG. 14 indicates a relation between the combined torque that is a combination of the dead weight torque of the pivotally supported part and the urging torque of the spring member 40, and the inclination angle of the first rotational unit 30. In this manner, in the lighting device 1, the urging force of the spring member 40 is set so that the combined torque of a certain value (LN 13 in FIG. 14) is applied to the first rotational unit 30, from minus 30 degrees to plus 45 degrees. Consequently, there is no neutral point in the rotation range of the first rotational unit 30, and it is possible to rotate the first rotational unit 30 in a smooth manner. In other words, because the load to be applied to an electric drive unit (driving source) does not change radically, it is possible to reduce the load to the motor.

Furthermore, for example, the angle adjustment device 2 remotely operates the second driving unit 27 (second motor 271) and the first driving unit 32 (first motor 321) using wireless communication. For example, the angle adjustment device 2 includes a control unit for wirelessly operating the irradiation direction of the lighting device 1. The control unit includes a transmission unit (remote controller) operated by an operator, a reception unit that is provided on the first rotational unit 30 and that receives control radio waves transmitted from the transmission unit, and a control device that controls the operations of the second motor 271 and the first motor 321, based on the control waves received by the reception unit. A conventional technique is applied to the control unit. Thus, to simplify the description and drawings, the detailed description and drawings of the control unit will be omitted.

For example, the angle adjustment device 2 is set so that the rotation angle (angle displacement amount) of the second rotational unit 20 in the horizontal direction when a single pulse is applied to the second motor 271, and the rotation angle (angle displacement amount) of the first rotational unit 30 in the vertical direction when a single pulse is applied to the first motor 321 are matched or about the same degree. In other words, the gear ratio between the second driving unit 27 and the first driving unit 32 may be determined so that the rotation angle (angle displacement amount) of the second rotational unit 20 in the horizontal direction when a single pulse is applied to the second driving unit 27, and the rotation angle (angle displacement amount) of the first rotational unit 30 in the vertical direction when a single pulse is applied to the first driving unit 32 are matched or about the same degree.

As described above, in the lighting device 1, the second rotational unit 20 rotates in the horizontal direction, and as a result, can rotate the irradiation direction (irradiation shaft) in the horizontal direction while maintaining the inclination angle relative to the vertical line. The rotating operation of the second rotational unit 20 in the horizontal direction by the second driving unit 27, and the rotating operation of the first rotational unit 30 in the vertical direction by the first driving unit 32 have been described separately. However, the control unit can simultaneously control the second driving unit 27 and the first driving unit 32, when an operator performs the operation using a remote controller. In other words, the angle adjustment device 2 can simultaneously perform the rotating operation of the second rotational unit 20 in the horizontal direction and the rotating operation of the first rotational unit 30 in the vertical direction.

In the present embodiment, the angle adjustment device 2 includes the second driving unit 27 for rotatably driving the second rotational unit 20 in the horizontal direction and the first driving unit 32 for rotatably driving the first rotational unit 30 in the vertical direction, which are disposed on the second rotational unit 20. By applying the angle adjustment device 2 such as this, it is possible to reduce the size, especially the whole length, of the lighting device 1. For example, it is possible to provide the lighting device 1 suitable for a ceiling universal downlight to be embedded in a ceiling that has a limited depth. Furthermore, by forming the internal teeth 11 on the inner periphery of the frame body 10, it is possible to reduce not only the size of the angle adjustment device 2 in the horizontal direction, but also the outer diameter of the frame body 10, compared to a case where external teeth are formed on the outer-periphery of the frame body 10. Consequently, it is possible to provide the lighting device 1 that can correspond to a smaller embedding hole.

Furthermore, the present invention is not limited to the embodiment described above. The present invention includes those configured by suitably combining the components described above. Furthermore, further advantages and modifications may easily be derived by those skilled in the art. Thus, the broader aspects of the present invention are not limited to the embodiment described above, and various modifications are possible.

For example, the following configuration is possible. By installing a plurality of the lighting devices 1 on the ceiling and connecting the lighting devices 1 using wireless communication, the control unit can simultaneously and remotely operate the lighting devices 1 using a single remote controller. Furthermore, the control unit not only remotely operates the lighting devices 1 through the wireless communication, but may also operate the lighting devices 1 by connecting an operation unit that is to be operated by an operator with the angle adjustment device 2 by wire, for example.

Furthermore, in the embodiment, the lighting device 1 is embedded in a ceiling. However, the present embodiment may also be applied to the lighting device 1 that is connected to an arm or the like, and that is hung down from a ceiling surface or a wall surface; the lighting device 1 that is supported by a base connected to the arm; and the like. The second motor 271 and the first motor 321 are not limited to a stepping motor, and may be a direct current (DC) motor, a DC brushless motor, an alternating current (AC) motor, or the like. In this case also, it is possible to simplify the current control by the control unit, when the rotation angle (angle displacement amount) of the second rotational unit 20 in the horizontal direction, and the rotation angle (angle displacement amount) of the first rotational unit 30 in the vertical direction are matched or about the same.

Furthermore, in the embodiment, the driving force of the driving source is the electric drive unit using a motor. However, the driving force of the driving source may be a manual drive unit such as a hand of a user and the like.

The object to be operated is not limited to the LED, and for example, may be another light source such as a krypton bulb. Furthermore, the angle adjustment device 2 may be used to change the direction of any object to be operated, in addition to the light source. For example, the object to be operated may be a sensor that has an image pick-up device and the like. In this manner, the object to be operated is optional as long as the direction of the object to be operated is to be changed in a desirable direction, and the angle adjustment device 2 can be applied to the object to be operated.

According to an aspect of the present invention, it is possible to rotationally move the object to be operated in a smooth manner.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An angle adjustment device, comprising:

a first rotational unit that is supported by a frame body, and that rotationally moves around a first rotating shaft passing through the frame body by a driving force of a motor, the first rotating shaft being disposed along a horizontal direction;

a second rotational unit that rotationally moves around a second rotating axis by a driving force of another motor, and that rotatably supports the first rotational unit around the first rotating shaft, the second rotating axis being different from a first rotating axis of the first rotating shaft; and a spring member that is fixed to the second rotational unit, wherein:

torque applied to the first rotational unit by the spring member changes as an inclination angle of the first rotational unit changes and increases as the first rotational unit rotates in a single direction of the first rotational unit, the inclination angle of the first rotational unit is limited by an electromechanical device, and the spring member comprises a bracket unit to which the another motor is fixed, and an urging unit that is formed as a spring that (i) urges the first rotational unit in a rotational direction of the first rotational unit and (ii) continues to a lower end of the bracket unit.

2. The angle adjustment device according to claim 1, wherein:

the spring member urges the first rotational unit within a rotationally movable range of the first rotational unit.

3. The angle adjustment device according to claim 2, wherein the rotationally movable range is a predetermined rotation range including a neutral point that is a point at which a gravity moment of a portion is balanced, the portion being pivotally supported by the first rotating shaft around the first rotating shaft.

4. The angle adjustment device according to claim 3, wherein the first rotational unit is inclined relative to a horizontal plane that is perpendicular to a gravity direction, in a state that is placed on the neutral point.

5. The angle adjustment device according to claim 1, wherein:

the spring member rotationally moves around the second rotating axis with the first rotational unit.

6. The angle adjustment device according to claim 1, wherein:

a sectional surface of the frame body perpendicular to the second rotating axis has an annular shape;

a sectional surface of the second rotational unit perpendicular to the second rotating axis has an annular shape;

the second rotational unit rotationally moves along an inner periphery of the frame body;

a sectional surface of the first rotational unit perpendicular to the second rotating axis has an annular shape; and the first rotational unit rotationally moves inside the second rotational unit.

7. The angle adjustment device according to claim 1, wherein:

the first rotating axis passes through the first rotational unit in a position other than a center of the first rotational unit in a plan view.

8. A lighting device, comprising:

the angle adjustment device according to claim 1, and a light source serving as an object to be operated of the angle adjustment device.

* * * * *